US005368206A

United States Patent [19]

Sandrin

[11] Patent Number: 5,368,206

[45] Date of Patent: Nov. 29, 1994

[54] DISPENSING APPARATUS FOR PASTY SUBSTANCES

[75] Inventor: Gianni Sandrin, Pordenone, Italy

[73] Assignee: Ro-Sa Plast S.p.A., Pordenone, Italy

[21] Appl. No.: 63,423

[22] Filed: May 19, 1993

[30] Foreign Application Priority Data

May 20, 1992 [IT] Italy ..... PN92 U 000019
Sep. 17, 1992 [IT] Italy ..... PN92 U 000030

[51] Int. Cl.[5] ..... B65D 88/54; B67D 5/42
[52] U.S. Cl. ..... 222/326; 222/389
[58] Field of Search ..... 222/82, 95, 105, 326, 222/389; 239/330

[56] References Cited

U.S. PATENT DOCUMENTS

| | | | |
|---|---|---|---|
| 2,329,917 | 9/1943 | Lautmann | 222/389 |
| 2,988,754 | 6/1961 | Misson | 239/330 |
| 3,847,304 | 11/1974 | Cohen | 222/326 |
| 4,198,756 | 4/1980 | Dragan | 222/326 |
| 4,600,126 | 7/1986 | Arango | 222/209 |
| 4,763,818 | 8/1988 | Stafano et al. | 222/209 |
| 5,115,948 | 5/1992 | Johnson | 222/209 |

FOREIGN PATENT DOCUMENTS

| | | | |
|---|---|---|---|
| 707144 | 5/1941 | Germany | 222/389 |
| 18615 | of 1902 | United Kingdom | 222/209 |

*Primary Examiner*—Andres Kashnikow
*Assistant Examiner*—Christopher G. Trainor
*Attorney, Agent, or Firm*—Wenderoth, Lind & Ponack

[57] ABSTRACT

A manually operated dispensing apparatus for dispensing pasty substances, in particular silicone, includes a hollow vessel, an air chamber formed by an elastically deformable wall, a double check valve placing the air chamber in communication with the interior of the vessel, a sealing element through which the paste to be dispensed is introduced, a front paste dispensing spout, a manually operated dispensing actuation lever, and a plunger located inside the hollow vessel. The dispensing actuation lever has two segments disposed at an angle with respect to each other. The elastically deformable wall is pressed by actuating the lever so as to cause air in the air chamber to be injected under pressure into a cavity in the vessel delimited by the plunger.

17 Claims, 3 Drawing Sheets

DISPENSING APPARATUS FOR PASTY SUBSTANCES

BACKGROUND OF THE INVENTION

This invention relates to an improved apparatus for dispensing pasty substances, such as in particular silicone, which are contained in tube-like flexible sealed vessels.

It is commonly appreciated that dispensing pasty substances both in industrial applications and at home is a duty having a number of prerequisites, i.e. easy and convenient use by a single operator, capability of dispensing the paste as a continuous, uninterrupted extruded strip that will break off abruptly and neatly as soon as the operator stops dispensing at his/her will, permanent separation of the paste to be dispensed from the air even for prolonged periods of time (so as to avoid interactions of the air with the substance to be dispensed, such as for instance silicone), and convenience in handling and reloading the dispensing apparatus.

Although many types of manually operated dispensers can meet these requirements, it becomes somewhat difficult to provide for such requirements in the case of dispensers that have to be used or operated with a single hand and that need to be particularly simple and low-cost in order to be feasible for use on an industrial scale.

Currently, the most widely used dispensing devices are manually operated dispensing guns in which a sealed cartridge containing the substance to be dispensed is inserted. The sealed cartridge terminates at its front dispensing end with a sealed spout, which is cut open immediately before using the gun, and at its opposite end with a substantially hermetically sealed element acting as a moving cap. The cap is disposed in the rear side of the outer casing of the cartridge so as to be capable of sliding forward under the thrusting action of a dispensing plunger.

The cartridge is loaded by inserting the same into the gun-type dispensing apparatus so that, upon closing the apparatus, the plunger is brought against the sealing element of the cartridge.

To operate such a type of dispensing apparatus, all that is then needed is to unseal the front dispensing spout, and operate a lever of the gun so that it acts on the plunger element. The plunger element, moving forward due to the actuation of the lever, pushes the sealing element forward toward the front dispensing spout so that the paste contained in the cartridge is ultimately squeezed out of the spout.

When there is no more paste left in the cartridge due to repeated dispensing, the plunger element is extracted from the body of the dispensing apparatus, while the empty cartridge is then replaced with a new, full cartridge, so that the above-described dispensing procedure may be restarted.

Because such dispensing apparatus are widely known, there is no need to describe them here any further.

These dispensing apparatus perform in a satisfactory way in cases of limited use or when there are no particular handling or maneuverability problems to be encountered. Conversely, when it comes to industrial applications, the following drawbacks appear to be associated therewith.

1) High costs. As a matter of fact, the cartridge containing the paste to be dispensed is usually made as a rigid plastic molding and, notwithstanding its altogether high costs, it is inevitably thrown away when emptied. In applications requiring great amounts of paste to be dispensed and, as a consequence, the use of a large number of cartridges, the ultimate expense that must be sustained for such one-way cartridges is certainly quite considerable.

2) Poor convenience in handling. When working in large structures, such as buildings, the operator needs to use tools that are very convenient to handle, compact and operable with a single hand, since it quite often occurs that the other hand needs to be used to keep the workpiece in place or the operator in a stable position. Dispensing guns of the traditional type are rather cumbersome and quite often require the use of both hands at the same time.

3) Poor cleanliness. When used intensively, traditional dispensing guns tend to allow the paste to seep through the inside the vessel of the apparatus containing the cartridge, thereby clogging it up or, anyway, making it more difficult and time-consuming to replace the cartridge.

SUMMARY OF THE INVENTION

It therefore would be desirable, and it is one of the objects of the present invention, to provide a dispensing apparatus for pasty substances which is capable of eliminating the above-mentioned drawbacks, is reliable with respect to both its operation and handling, can be used in mass-manufacturing applications, and can be produced with practicable techniques.

To achieve this object, the present invention provides a manually operatable dispensing apparatus including a hollow vessel, a plunger disposed within and slidably fitted to the vessel, an elastically deformable member defining an air chamber, a double check valve placing the air chamber in communication with the interior of the hollow vessel and the interior of the hollow vessel in communication with the outside environment, a manually operatable actuation lever having a segment disposed over the elastically deformable member and articulatable to deform the member and force air into the vessel via the double check valve to move the plunger, a removable sealing element by which the vessel can be refilled with substances to be dispensed, and a dispensing spout.

It will, however, be fully apparent that the dispensing apparatus according to the present invention can actually be advantageously used in all cases where the need arises to dispense in a controlled way a pasty substance stuffed into containers that must be replaced when emptied.

BRIEF DESCRIPTION OF THE DRAWINGS

Further features and characteristics of the invention will become apparent from the following description of a non-limiting example made with reference to the accompanying drawings in which.

DETAILED DESCRIPTION OF THE PREFERRED EMBODIMENTS

Figure 2:
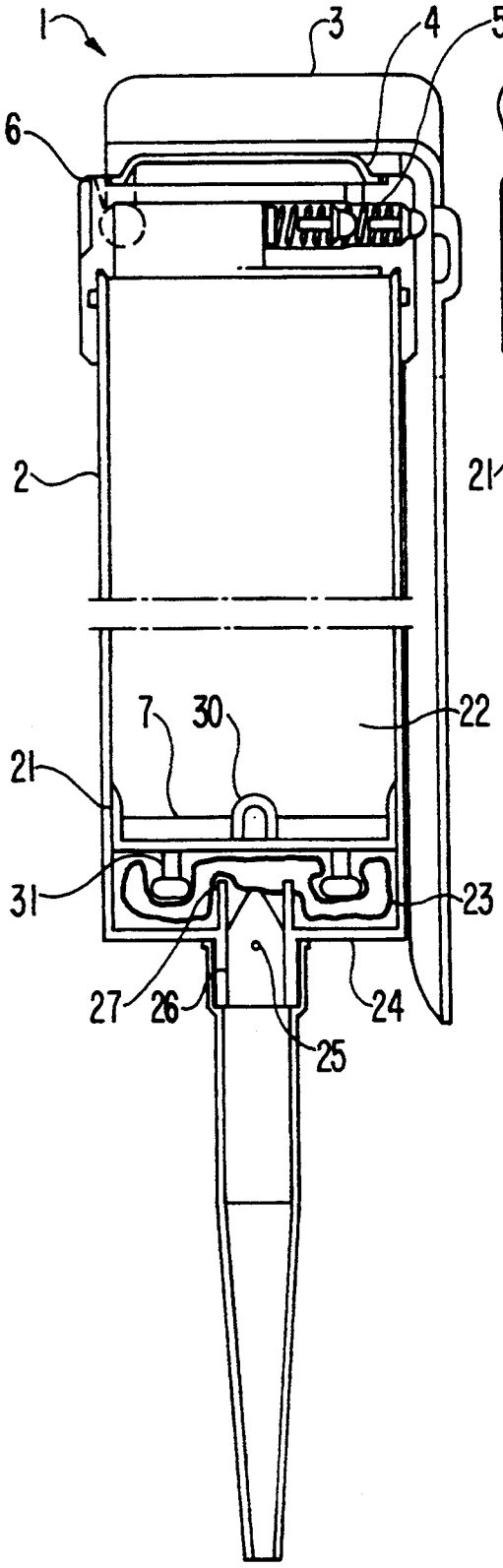
FIG. 2 is a similar cross-sectional view showing the actuation lever fully lowered at the end of the dispensing phase.
Figure 1:
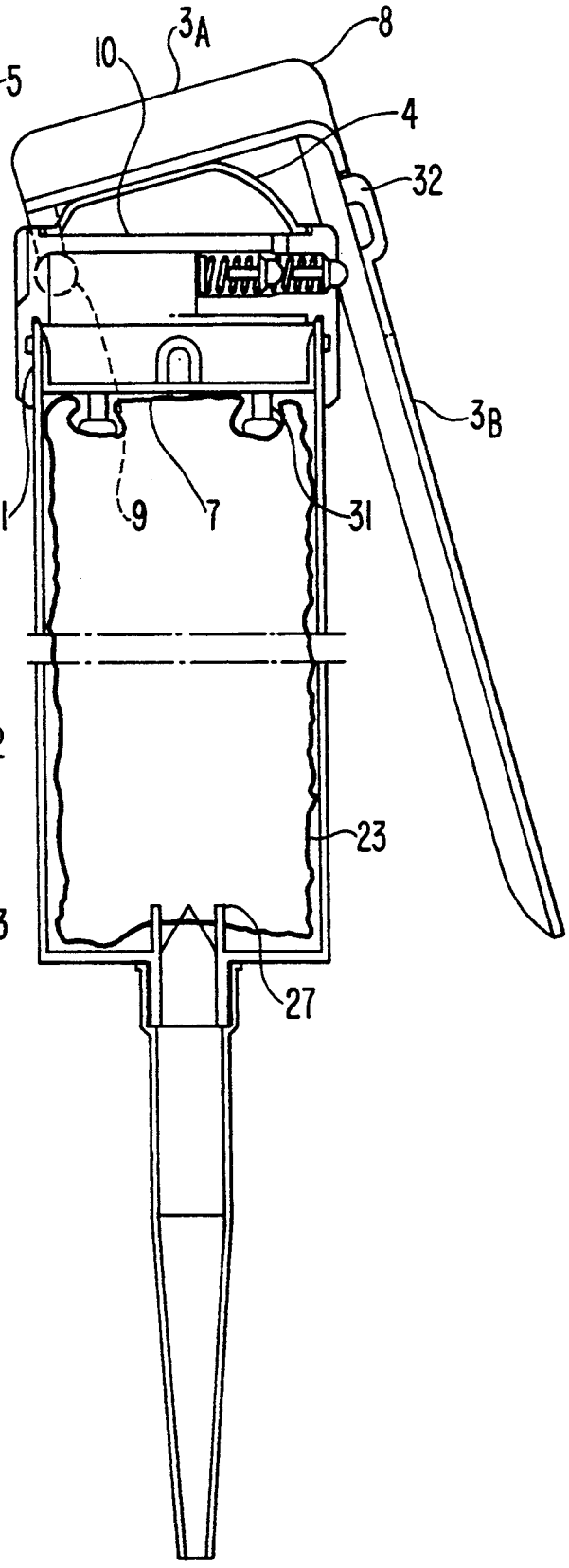
FIG. 1 is a longitudinal cross-sectional view of the dispensing apparatus according to the present invention, shown in the condition in which the actuation lever is lifted.
Figure 3:
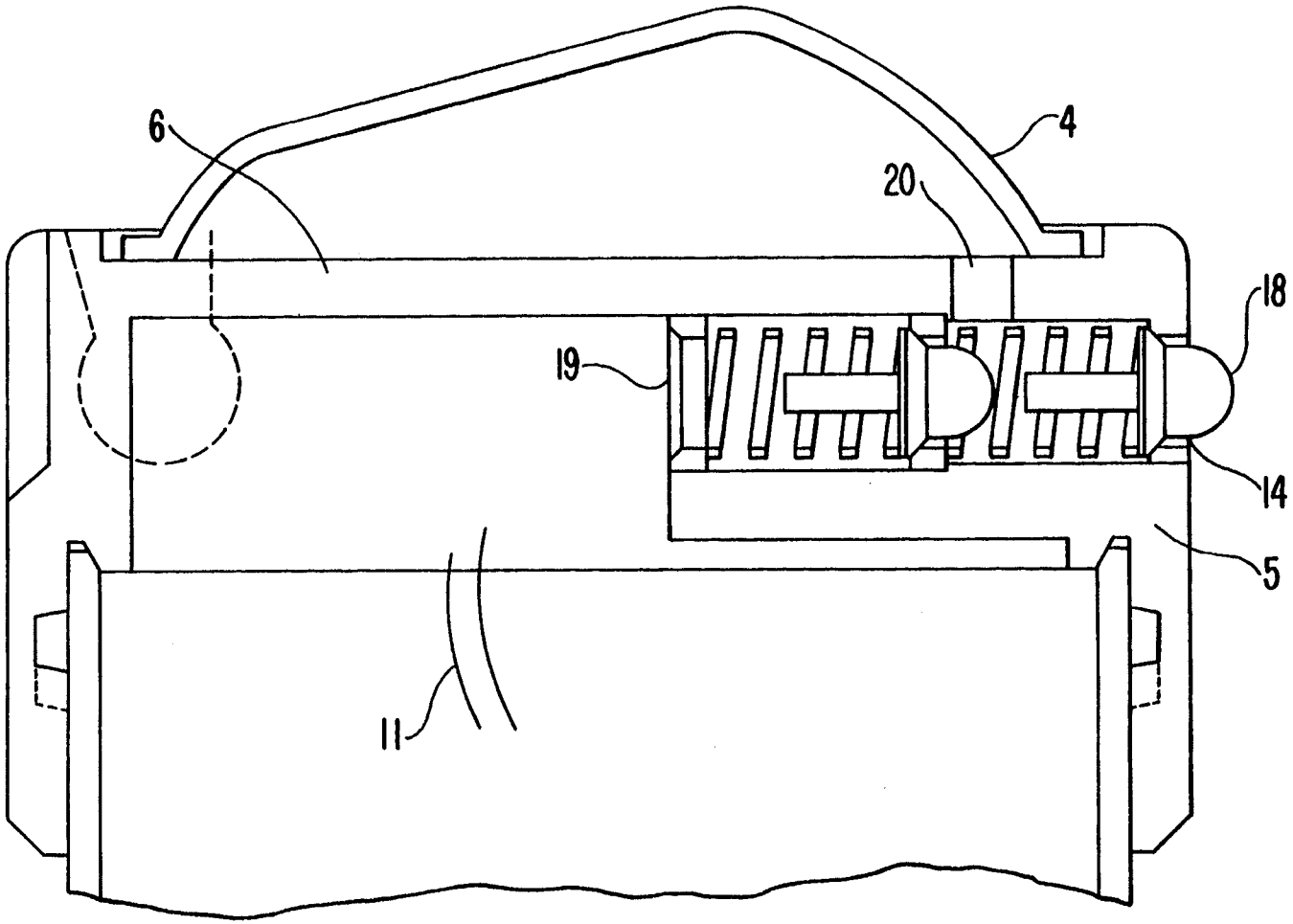
FIG. 3 is an enlarged view of the zone surrounding the double check valve.

Referring now to the Figures, an apparatus 1 for dispensing pasty substances comprises a hollow vessel 2, a dispensing actuation lever 3, an elastically deformable member 4 defining an air chamber and having substantially the shape of a segment of a sphere, a double check valve 5 to let air in and out, a rear sealing element 6 closing the hollow vessel 2 at its rear, and a plunger element 7 slidable inside the hollow vessel 2.

The actuation lever 3 is bent substantially at a right angle at 8, wherein the lever can be thought of as divided into two segments 3*a* and 3*b*.

The segment 3*a* is hinged at a point 9 on an outer rim of the sealing element 6, and it rests, when being pushed, against the elastically deformable member 4. The edge of member 4 is disposed against and tightly sealed by the circular outer peripheral surface 10 of the sealing element 6.

The segment 3*b* projects forward from segment 3*a* and is substantially coplanar with respect to the vessel 2.

The sealing element 6 is fixed to the rear portion of the vessel 2 by regular screw threads or similar fastening means.

The valve 5 is provided on the inner side of said sealing element 6 in an appropriate receptacle constituting the valve body.

The valve 5 may be of a per se known type; in particular, the body of the valve 5 is provided with three bores to ensure the passage of and regulate the air flow.

More specifically, the bore 29 lets air into the inner cavity 11 of the hollow vessel 2.

The bore 14 extends through a wall of the sealing element 6, wherein the pin 18 of the valve protrudes from the surface of the sealing element 6 adjacent the segment 3*b* of the lever 3. A relief aperture is provided in the segment 3*b*, in correspondence with the protruding pin 18 of the valve 5, so that when the segment 3*b* is pressed against the body of the vessel 2, the pin 18 is not pressed by the segment 3*b*.

The bore 20 extends through a side wall of the sealing element 6 so that it communicates with the interior of the air chamber.

The side surface 21 of plunger element 7 contacts, in a substantially tightly sealing state, a corresponding inner surface of the vessel 2.

The dispensing zone of the hollow vessel is sealed by a wall 24 that has a bore through its central portion. In such a bore there is inserted an element 26, or dispensing spout, which is substantially cylindrical and open at both ends so as to place the inside of the vessel in communication with the outside. The element 26 also has rather sharp edges 27 at the inner side thereof.

The dispensing apparatus according to the present invention operates in the following manner. After unsealing the rear portion of the hollow vessel 2, by unscrewing the sealing element 6, and extracting the plunger element 7 therefrom, preferably with the aid of a string connected to the rear portion of the plunger element, a flexible vessel 23, typically in the shape of a pouch and filled with the paste to be dispensed, is inserted in the hollow vessel 2.

Then the plunger element 7 is closed in again by pushing it with the flexible vessel 23 until it reaches a position determined by the pouch-like flexible vessel having completely filled the hollow vessel 2, i.e. having been fully inserted toward the front wall 24 of the vessel 2.

Then the sealing element 6 is again mounted on the vessel 2 by screwing it on the rear portion of the vessel 2, whereupon the dispensing apparatus is ready for use.

At this point, all it takes to operate the dispensing apparatus is seizing the vessel 2 and, while holding it with one hand, repeatedly pressing down the lifted segment 3*b* against the body of the same vessel. Upon each force exerted in this way on the lever, the segment 3*a* thereof is caused to press against the elastically deformable member 4 which, following the reduction in the volume of the air chamber, ejects the air contained therein through the bore 20 and, thereafter, through the bore 29 provided in the valve 5 and into the inner cavity 11 of the hollow vessel 2, namely the cavity formed between the inner surface of the sealing element 6 and the plunger element 7.

At the end of its downstroke, the lever 3 returns automatically to its lifted, i.e. initial or starting position due to the spring-back action of the material which the elastically deformable member 4 is made of. During this automatic return movement of the lever, the interior of the air chamber fills up again with new air that is taken in from the outside through the bore 14 and the bore 20 as described above.

When the lever is returned to its initial, lifted position, the segment 3*b* is pressed down again if the operation of the dispenser is to be repeated.

As the amount of air forced to flow into the inner cavity of the vessel 2 increases, there will also be an increase in the pressure tending to push the plunger element 7 forward, thereby first causing the flexible vessel to be pierced by the inner edges 27 of the dispensing spout 26 and then causing the paste contained in the flexible vessel 23, to be squeezed out of the aperture in the vessel, into the spout 26 and then to the outside.

When the paste in the flexible vessel is fully dispensed and the same vessel is therefore empty, the plunger element 7 will stop and this will cause the lever 3 to substantially become stiff and get jammed.

Alerted by this fact, the operator will at first remove the overpressure existing inside the vessel 2 by simply pressing down the pin 18 with a push-button 32 or similar means. This will be effective in placing the interior of the vessel 2, under pressure, in direct communication with the outside through the bores 14 and 19 of the valve 5, thereby bringing about an almost immediate pressure equalization.

Once this has been accomplished, the sealing element 6 will be capable of being removed quite easily, so that the plunger element 7 can be extracted from the vessel 2, preferably with the aid of a string or similar means attached to a fastening element 30 thereof, such as for instance a grommet provided on the outer surface of the plunger element 7.

Through such a removal of the plunger element 7, the flexible vessel 23 becomes released, so that it can be easily extracted from the vessel 2, too.

For convenience, the inner surface of the plunger element 7 may be provided with fungiform protrusions 31 free from sharp edges. Such protrusions, owing to the pressure between the plunger element 7 and the flexible vessel 2, will grab the flexible vessel, albeit without piercing or tearing it open, so that the plunger element 7, when extracted from the vessel 2, will automatically pull out the flexible vessel 23 which is firmly held by the protrusions 31.

While this dispensing apparatus operates in an altogether satisfactory way, it still may experience the following drawbacks:

in the first place, the cylindrical hollow vessel is subject to manufacturability problems which in any case, although solvable with currently available techniques, brings about higher fabrication, tooling and mold costs;

in the second place, the protrusions that get inserted into the flexible vessel filled with pasty substance, and which serve to extract the flexible vessel when it is empty, can easily tear or break it, resulting in some of the substance still in the flexible vessel escaping therethrough; this leaking substance, by spreading all around and drying up, would surely clog the inner cavity of the hollow vessel, thereby interfering with the insertion of a new flexible vessel filled with a pasty substance, the subsequent capping or sealing of the same hollow vessel and the free maneuverability of the actuating lever.

Figure 4:
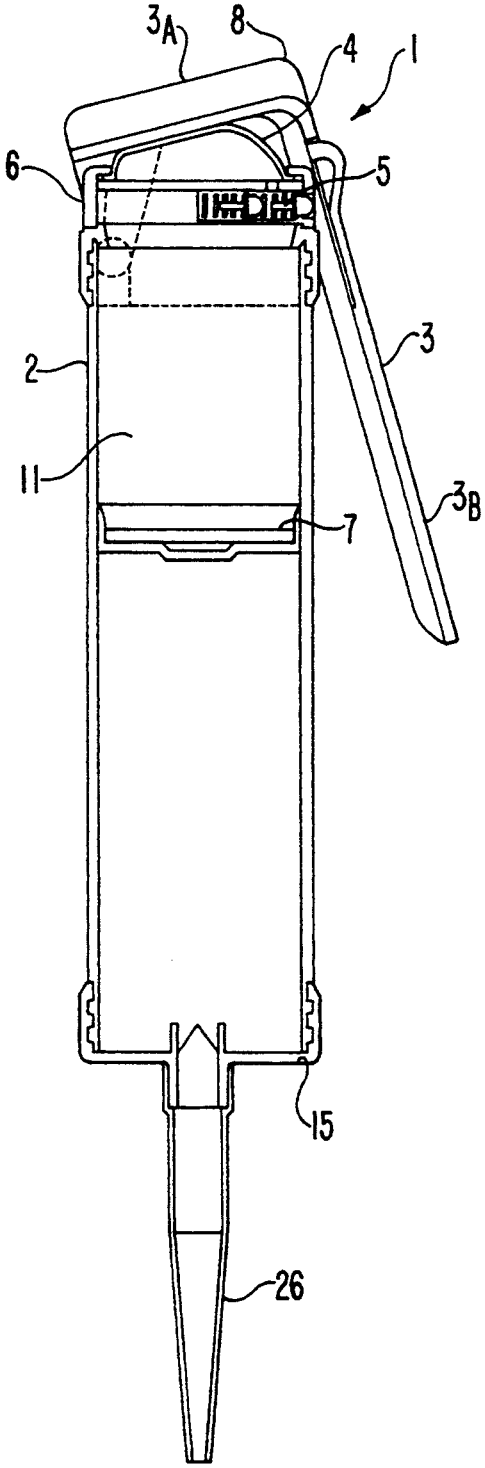
FIG. 4 is a longitudinal sectional view of another embodiment of the dispensing apparatus according to the present invention.
Figure 5:
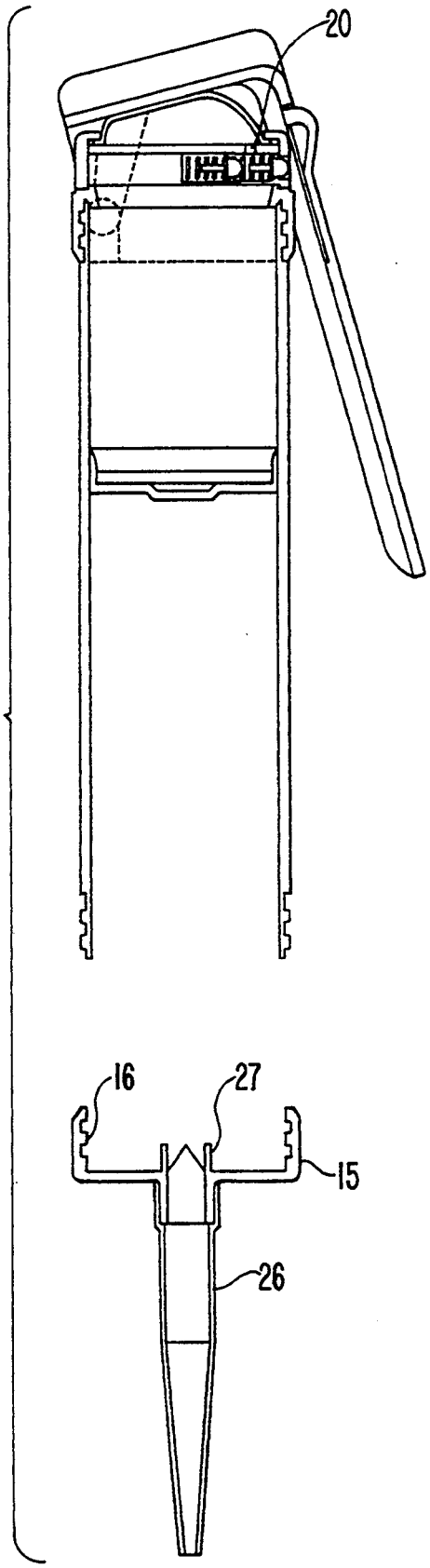
FIG. 5 is an exploded view, in section, of the embodiment shown in FIG. 4.

The embodiment of the apparatus according to the present invention, shown in FIGS. 4 and 5, has been developed to eliminate the above drawbacks. Instead of being loaded and unloaded from the rear through the provision of a sealing element 6, the dispensing apparatus of FIGS. 4 and 5 is provided with a front sealing element 15 which is capable of being removed from and mounted to the body of the hollow vessel by any appropriate means such as screw-on threads 16, a snap-fit, etc.

The pasty substance may be dispensed from the flexible vessel by merely removing the front sealing element, taking out the empty flexible vessel that had been previously inserted in the hollow vessel of the dispensing apparatus, introducing a new flexible vessel filled with the pasty substance into the vessel thereby pushing the plunger element (7) backwards, and again capping the vessel with the front sealing element 15.

Even in this case the inner edge 27 of the dispensing spout 26 will perforate the flexible vessel full of a pasty substance under the thrusting action exerted by the plunger element 7, so that the dispensing apparatus is ready for use and the paste can be dispensed to the outside.

All it takes now to operate the dispensing apparatus is doing exactly what has been described in connection with the previously described embodiment.

A further advantage of this embodiment of the present invention derives from the fact that it eliminates the necessity of the protrusions for securing the flexible vessel to the surface of the plunger element 7.

By doing away with the protrusions, the risk of the flexible vessel becoming torn or broken, with a resulting leakage of paste and clogging of the apparatus, is practically eliminated.

The features, characteristics and advantages of the apparatus are: a simple and cost-effective structure; convenient to handle during use, since the apparatus can be held and used with a single hand, allowing the operator to work with the body held in positions that may also be quite critical or difficult; overall economy, since it does not require the use of a rather expensive rigid one-way cartridge each time that it must be refilled with paste; and overall cleanliness, since the apparatus is not soiled by paste, even after prolonged use.

It will of course be apparent that various changes and modifications of the dispensing apparatus will become apparent to those of ordinary skill in the art. Such changes and modifications are seen to be within the true spirit and scope of the present invention.

I claim:

1. A manually operatable dispensing apparatus comprising: a hollow vessel having a rear end and an open front end; a plunger disposed within and slidable relative to said hollow vessel in a direction along a longitudinal axis of the vessel; an elastically deformable member forming an air chamber discrete from the interior of said hollow vessel; a double check valve placing said air chamber in communication with a cavity defined within said hollow vessel between said plunger and the rear end of the vessel and placing the interior of said hollow vessel in communication with the environment outside of the hollow vessel; a manually operatable actuation lever having two segments disposed at an angle relative to each other, one of said segments overlying said elastically deformable member, and said lever being articulatable such that movement of said lever relative to said hollow vessel causes said elastically deformable member to force air from said air chamber into said hollow vessel via said double check valve; a front removable sealing element detachably secured to the front end of said hollow vessel; and a dispensing spout integral with said front sealing element so as to be detachable from the front end of said hollow vessel along with said front sealing element, said dispensing spout defining a passageway which opens through said front sealing element to the interior of said hollow vessel and is open to the environment outside of said vessel.

2. A manually operatable dispensing apparatus as claimed in claim 1, and further comprising a rear sealing element detachably secured to the rear end of said hollow vessel.

3. A manually operatable dispensing apparatus as claimed in claim 2, wherein said elastically deformable member is fixed to said rear sealing element.

4. A manually operatable dispensing apparatus as claimed in claim 2, wherein said one of said segments of said actuation lever is pivotably mounted to an outer peripheral portion of said rear sealing element, said segments are disposed at a substantially right angle to each other, and the other of said segments extends parallel to the longitudinal axis of the hollow vessel.

5. A manually operatable dispensing apparatus as claimed in claim 3, wherein said one of said segments of said actuation lever is pivotably mounted to an outer peripheral portion of said rear sealing element, said segments are disposed at a substantially right angle to each other, and the other of said segments extends parallel to the longitudinal axis of the hollow vessel.

6. A manually operatable dispensing apparatus as claimed in claim 5, wherein said elastically deformable member has the shape of a segment of a sphere, and an edge of said elastically deformable member is secured and sealed along an outer peripheral portion of said rear sealing element.

7. A manually operatable dispensing apparatus as claimed in claim 1, wherein said double check valve has a hollow valve body, two spring-biased shutter members disposed coaxially within said valve body, a first aperture placing the interior of said valve body in communication with the environment outside of the hollow vessel, a second aperture placing the interior of said valve body in communication with the interior of said hollow vessel, and a third aperture placing the interior of said valve body in communication with the interior of said air chamber.

8. A manually operatable dispensing apparatus as claimed in claim 7, wherein one of said shutter members normally protrudes from said first aperture, and the other of said segments of said actuation lever has a push-button, said push-button being pressable to force said one of said shutter members into said valve body and out of said first aperture to thereby allow the interior of said hollow vessel to be vented through said double check valve to the environment outside of said hollow vessel.

9. A manually operatable dispensing apparatus as claimed in claim 1, wherein said front sealing element is threaded to said hollow vessel.

10. A manually operatable dispensing apparatus comprising: a hollow vessel having an open rear end and a front end; a plunger disposed within and slidable relative to said hollow vessel in a direction along a longitudinal axis of the vessel; an elastically deformable member forming an air chamber discrete from the interior of said hollow vessel; a rear sealing element closing the rear end of said hollow vessel, said rear sealing element having an aperture therethrough open to said air chamber; a double check valve placing said aperture open to the air chamber in communication with a cavity defined in said hollow vessel between said plunger and said rear sealing element, and placing the interior of said hollow vessel in communication with the environment outside of the hollow vessel; a manually operatable actuation lever having two segments disposed at a substantially right angle relative to each other, one of said segments overlying said elastically deformable member, the other of said segments extending parallel to the longitudinal axis of said vessel, and said one of the segments of said lever being pivotably mounted to an outer peripheral portion of said rear sealing element such that movement of said lever relative to said vessel causes said one of the segments to deform said elastically deformable member to force air from said air chamber into said hollow vessel via said aperture and said double check valve; and a dispensing spout at the front end of said hollow vessel.

11. A manually operatable dispensing apparatus comprising: a hollow vessel having an open rear end and a front end; a plunger disposed within and slidable relative to said hollow vessel in a direction along a longitudinal axis of the vessel; an elastically deformable member forming an air chamber discrete from the interior of said hollow vessel, said elastically deformable member having substantially the shape of a segment of a sphere; a rear sealing element closing the rear end of said vessel, said rear sealing element having an aperture therethrough open to said air chamber, an edge of said elastically deformable member being secured to and sealed along an outer peripheral portion of said rear sealing element; a double check valve placing said aperture open to the air chamber in communication with a cavity defined in said hollow vessel between said plunger and said rear sealing element, and placing the interior of said hollow vessel in communication with the environment outside of the hollow vessel; a manually operatable actuation lever having two segments disposed at an angle relative to each other, one of said segments overlying said elastically deformable member, and said lever being articulatable such that movement of said lever relative to said vessel causes said elastically deformable member to force air from said air chamber into said hollow vessel via said aperture and said double check valve; and a dispensing spout at the front end of said hollow vessel.

12. A manually operatable dispensing apparatus comprising: a hollow vessel having an open rear end and a front end; a plunger disposed within and slidable relative to said hollow vessel in a direction along a longitudinal axis of the vessel; an elastically deformable member forming an air chamber discrete from the interior of said hollow vessel; a rear sealing element closing the rear end of said vessel, said rear sealing element having an aperture therethrough open to said air chamber; a double check valve having a hollow valve body the interior of which is open to said aperture in the rear sealing element, two spring-biased shutter members disposed coaxially within said valve body, a first aperture placing a cavity defined in said hollow vessel between said plunger and said rear sealing element in communication with the environment outside of the hollow vessel, and a second aperture placing the interior of said valve body in communication with said cavity; a manually operatable actuation lever having two segments disposed at an angle relative to each other, one of said segments overlying said elastically deformable member the other of said segments extending parallel to the longitudinal axis of said vessel, and said lever being articulatable such that movement of said lever relative to said vessel causes said elastically deformable member to force air from said air chamber into said hollow vessel via said aperture in the rear sealing element and the second aperture of said double check valve; and a dispensing spout at the front end of said hollow vessel.

13. A manually operatable dispensing apparatus as claimed in claim 12, wherein one of said shutter members normally protrudes from said first aperture, and the other of said segments of said actuation lever has a push-button, said push-button being pressable to force said one of said shutter members into said valve body and out of said first aperture to thereby allow the interior of said hollow vessel to be vented through said double check valve to the environment outside of said hollow vessel.

14. A manually operatable dispensing apparatus comprising: a hollow vessel having an open rear end and a front end; an elastically deformable member forming an air chamber discrete from the interior of said hollow vessel; a rear sealing element detachably mounted to said vessel and closing the rear end thereof, said rear sealing element having an aperture therethrough open to said air chamber; a plunger disposed within and slidable relative to said hollow vessel in a direction along a longitudinal axis of the vessel, said plunger having extraction means, on a rear surface thereof facing said rear sealing element, for allowing the plunger to be pulled out of said vessel when located at the front end thereof and said rear sealing element has been detached from the vessel; a double check valve placing said aperture open to the air chamber in communication with a cavity defined in said hollow vessel between said plunger and said rear sealing element, and placing the interior of said hollow vessel in communication with the environment outside of the hollow vessel; a manually operatable actuation lever having two segments disposed at an angle relative to each other, one of said segments overlying said elastically deformable member, and said lever being articulatable such that movement of said lever relative to said vessel causes said elastically deformable member to force air from said air chamber into said hollow vessel via said aperture and said double check valve; and a dispensing spout at the front end of said hollow vessel.

15. A manually operatable dispensing apparatus as claimed in claim 14, wherein said extraction means comprises a fastening element and a string connected to the fastening element.

16. A manually operatable dispensing apparatus comprising: a hollow vessel having an open rear end and a front end; an elastically deformable member forming an air chamber discrete from the interior of said hollow vessel; a rear sealing element detachably mounted to said vessel and closing the rear end thereof, said rear sealing element having an aperture therethrough open to said air chamber; a plunger disposed within and slidable relative to said hollow vessel in a direction along a longitudinal axis of the vessel, said plunger having flexible vessel-grabbing protrusions, at a front portion thereof facing the front end of the vessel, which will grab an emptied flexible vessel from which a pasty substance has been dispensed under the action of the plunger; a double check valve placing said air chamber in communication with a cavity defined in said hollow vessel between said plunger and said rear sealing element, and placing the interior of said hollow vessel in communication with the environment outside of the hollow vessel; a manually operatable actuation lever having two segments disposed at an angle relative to each other, one of said segments overlying said elastically deformable member, and said lever being articulatable such that movement of said lever relative to said vessel causes said elastically deformable member to force air from said air chamber into said hollow vessel via said aperture and said double check valve; and a dispensing spout at the front end of said hollow vessel.

17. A manually operatable dispensing apparatus as claimed in claim 16, wherein said protrusions are fungiform.

* * * * *